US011497958B2

(12) United States Patent
Rothacker

(10) Patent No.: US 11,497,958 B2
(45) Date of Patent: Nov. 15, 2022

(54) NECK EXERCISE APPARATUS

(71) Applicant: Alexander M. Rothacker, Wildwood, IL (US)

(72) Inventor: Alexander M. Rothacker, Wildwood, IL (US)

( * ) Notice: Subject to any disclaimer, the term of this patent is extended or adjusted under 35 U.S.C. 154(b) by 84 days.

(21) Appl. No.: 17/249,508

(22) Filed: Mar. 3, 2021

(65) Prior Publication Data

US 2021/0275868 A1 Sep. 9, 2021

Related U.S. Application Data

(60) Provisional application No. 62/984,999, filed on Mar. 4, 2020.

(51) Int. Cl.

| | |
|---|---|
| ***A63B 23/025*** | (2006.01) |
| ***A63B 21/00*** | (2006.01) |
| ***A63B 21/075*** | (2006.01) |
| ***A63B 21/062*** | (2006.01) |
| *A63B 71/00* | (2006.01) |

(52) U.S. Cl.

CPC ..... *A63B 23/025* (2013.01); *A63B 21/063* (2015.10); *A63B 21/075* (2013.01); *A63B 21/4035* (2015.10); *A63B 21/4047* (2015.10); *A63B 2071/0072* (2013.01); *A63B 2225/093* (2013.01)

(58) Field of Classification Search

CPC ... A63B 21/063; A63B 21/075; A63B 21/078; A63B 21/4035; A63B 21/4047; A63B 23/025; A63B 2071/0072; A63B 2225/093

See application file for complete search history.

(56) References Cited

U.S. PATENT DOCUMENTS

| | | | | | |
|---|---|---|---|---|---|
| 2,855,202 | A * | 10/1958 | Kinne | A63B 21/4003 | 482/10 |
| 4,278,249 | A * | 7/1981 | Forrest | A63B 23/025 | 482/10 |
| 4,302,005 | A * | 11/1981 | Silberman | A63B 21/4047 | 482/10 |
| 5,984,836 | A * | 11/1999 | Casali | A63B 21/4003 | 602/17 |
| 8,876,665 | B1 * | 11/2014 | Isom | A63B 23/025 | 482/93 |

* cited by examiner

*Primary Examiner* — Joshua Lee
(74) *Attorney, Agent, or Firm* — Marshall, Gerstein & Borun LLP

(57) ABSTRACT

A neck exercise apparatus includes a neck lever pivotably attached to a channel member. The neck lever has a head portion in front of the channel member. The neck lever is selectively movable along the channel member and the neck lever pivots about a pivot point that is located behind the channel member. The neck lever includes a weight attachment element configured to receive incremental additions of weight.

17 Claims, 2 Drawing Sheets

NECK EXERCISE APPARATUS

FIELD OF THE DISCLOSURE

The invention relates generally to exercise equipment and more particularly to a weight training exercise machine that targets human neck muscles.

BACKGROUND

Resistance training is generally recognized as being necessary for improving health and fitness. Resistance training generally includes body weight exercises or exercises involving lifting free weights or weight machines. While some muscle groups are well known and targeted with weight lifting exercises and weight machines, such as the chest, back and legs, other muscle groups are often overlooked. Weight lifting machines are known that target major and some minor muscle groups. Weight lifting machines usually involve some sort of lever or pulley, to which weight is added, that allows a specified movement that targets a specific muscle or group. However, some muscle groups, such as the neck, have been overlooked by weight machine manufacturers.

SUMMARY

The invention relates to a neck exercise apparatus which focuses on isolating and strengthening the neck muscles.

In one example, the neck exercise apparatus includes a neck lever pivotably attached to a channel member. The neck lever has a head portion in front of the channel member. The neck lever is selectively movable along the channel member and the neck lever pivots about a pivot point that is located behind the channel member. The neck lever includes a weight attachment element configured to receive incremental additions of weight.

In other embodiments, the example neck exercise machine may take on any one or more of the following optional forms.

In one optional form, the weight attachment element is a bar.

In another optional form, the weight attachment element is a cable attached to a plurality of weight plates.

In yet another optional form, the weight attachment is located above the head portion of the neck lever.

In yet another optional form, the neck lever includes a neck height adjustment mechanism.

In yet another optional form, the neck height adjustment mechanism comprises a spring loaded pin.

In yet another optional form, an adjustable handle is separated from the neck lever, the adjustable handle being slidable along the channel member.

In yet another optional form, the adjustable handle comprises a handle height adjustment mechanism.

In yet another optional form, the handle height adjustment mechanism comprises a spring loaded pin.

In yet another optional form, a base plate is attached to the channel member.

In yet another optional form, a head pad is disposed on the neck lever opposite the weight attachment.

In yet another optional form, a limit stop is located on the neck lever, the limit stop limiting pivotable movement of the neck lever.

In yet another optional form, the limit stop is a plate and a pin mounted between the channel member and the head pad.

DETAILED DESCRIPTION

A neck exercise apparatus is described that focuses on isolating and strengthening the neck muscles. The disclosed neck exercise apparatus safely and effectively facilitates resistance training, and more specifically weight training, of the neck muscles.

Figure 1:
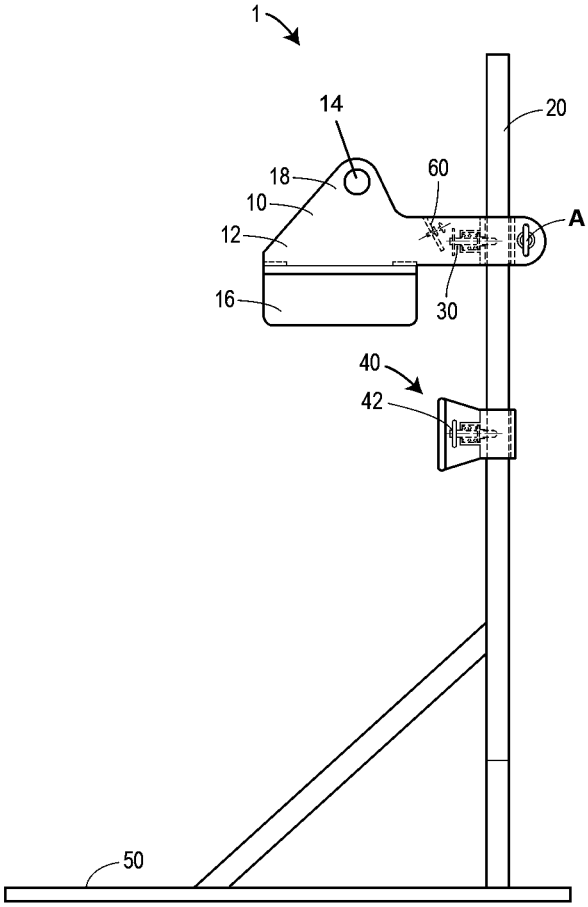
FIG. 1 is a side elevational view of one embodiment of a neck exercise apparatus constructed in accordance with the teachings of the disclosure.
Figure 2:
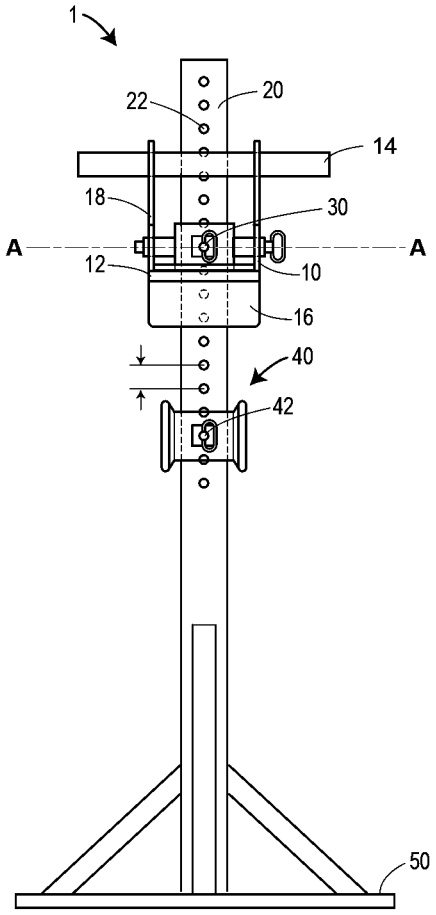
FIG. 2 is a front elevational view of the neck exercise apparatus of FIG. 1.

Turning now to FIGS. 1 and 2, a neck exercise apparatus 1 includes a neck lever 10 pivotably attached to a channel member 20. The channel member 20 may comprise a rigid durable material, preferably a metal such as steel or aluminum. The channel member 20 may comprise a cross-section in the shape of a U-channel. The channel member 20 may comprise a plurality of openings 22 that are used to adjust the neck lever 10 as discussed further below.

The neck lever 10 has a head portion 12 in front of the channel member 20. The neck lever 10 is selectively movable along the channel member 20 and the neck lever 10 pivots about a pivot axis A that is located behind the channel member 20. The neck lever 10 is canteliverly mounted to the channel member 20. The neck lever 10 may comprise a head pad 16 located on a bottom surface thereof. The head portion 12 may comprise a triangular projection 18 that extends opposite the head pad 16.

The neck lever 10 includes a weight attachment element 14 configured to receive incremental additions of weight. In the illustrated embodiment, the weight attachment element 14 is a bar that is located on the triangular projection 18. In other embodiments, the weight attachment element 14 may comprise a cable attached to a plurality of weight plates. In the illustrated embodiment, the weight attachment element 14 is located above the head portion 12 of the neck lever 10.

The neck lever 10 includes a neck height adjustment mechanism 30. The neck height adjustment mechanism 30 comprises a spring loaded pin that cooperates with the plurality of openings 22 on the channel member 20 to adjust the height of the neck lever 10. The spring loaded pin seats in one opening 22 when the neck lever 10 is desirably positioned to releasably lock the neck lever 10 in the desired position along the channel member 20.

An adjustable handle is 40 separated from the neck lever 10, the adjustable handle 40 being slidable along the channel member 20. The adjustable handle 40 comprises a handle height adjustment mechanism 42. In the illustrated embodiment, the handle height adjustment mechanism 42 comprises a spring loaded pin and operates similar to the neck height adjustment mechanism 30 described above.

In some embodiments, a base plate 50 may be attached to the channel member 20 to stabilize and support the channel member 20 in a free-standing orientation.

In some embodiments, a limit stop 60 is located on the neck lever 10, the limit stop 60 limiting pivotable movement of the neck lever 10 to a safe range of motion. In the illustrated embodiment, the limit stop 60 is a plate and a pin mounted between the channel member 20 and the head pad 16.

The described neck exercise apparatus advantageously exercises the human neck muscles over a full range of motion, from fully flexed to fully extended. Furthermore, the exercise position while using the machine is anatomically correct, which reduces the chance of injury. Additionally, use of the described neck exercise apparatus exercises muscles over the full body, from the feet to the neck as the major muscle groups are activated during use to stabilize and support the neck.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A neck exercise apparatus, comprising:

a neck lever pivotably attached to a channel member, the neck lever having a head portion in front of the channel member, the neck lever being selectively movable along the channel member, and the neck lever pivoting about a pivot point that is located behind the channel member; and an adjustable handle separated from the neck lever, the adjustable handle being slidable along the channel member, wherein the neck lever includes a weight attachment element configured to receive incremental additions of weight.

2. The neck exercise apparatus of claim 1, wherein the weight attachment element is a bar.

3. The neck exercise apparatus of claim 1, wherein the weight attachment element is a cable attached to a plurality of weight plates.

4. The neck exercise apparatus of claim 1, wherein the weight attachment element is located above the head portion of the neck lever.

5. The neck exercise apparatus of claim 1, further comprising a neck height adjustment mechanism.

6. The neck exercise apparatus of claim 5, wherein the neck height adjustment mechanism comprises a spring loaded pin.

7. The neck exercise apparatus of claim 1, wherein the adjustable handle comprises a handle height adjustment mechanism.

8. The neck exercise apparatus of claim 7, wherein the handle height adjustment mechanism comprises a spring loaded pin.

9. The neck exercise apparatus of claim 1, further comprising a base plate attached to the channel member.

10. The neck exercise apparatus of claim 1, further comprising a head pad on the neck lever opposite the weight attachment.

11. The neck exercise apparatus of claim 1, further comprising a limit stop that limits pivotable movement of the neck lever.

12. The neck exercise apparatus of claim 11, wherein the limit stop is a plate and a pin mounted between the channel member and the head pad.

13. The neck exercise apparatus of claim 1, wherein the channel member has a u-shaped cross-section.

14. The neck exercise apparatus of claim 1, wherein the channel member comprises a plurality of openings.

15. The neck exercise apparatus of claim 1, wherein the neck lever is cantileverly mounted to the channel member.

16. The neck exercise apparatus of claim 1, wherein the head portion comprises a triangular projection.

17. A neck exercise apparatus, comprising:

a neck lever pivotably attached to a channel member, the neck lever having a head portion in front of the channel member, the neck lever being selectively movable along the channel member, and the neck lever pivoting about a pivot point that is located behind the channel member, wherein the neck lever includes a weight attachment element configured to receive incremental additions of weight, wherein the head portion comprises a triangular projection, and wherein the weight attachment element is located on the triangular projection.

* * * * *